United States Patent [19]

Suzuki et al.

[11] Patent Number: 4,564,287

[45] Date of Patent: Jan. 14, 1986

[54] IMAGE FORMATION APPARATUS INCLUDING MEANS FOR DETECTING AND CONTROLLING IMAGE FORMATION CONDITION

[75] Inventors: Koji Suzuki, Yokohama; Kouki Kuroda; Jyoji Nagahira, both of Tokyo, all of Japan

[73] Assignee: Canon Kabushiki Kaisha, Tokyo, Japan

[21] Appl. No.: 640,654

[22] Filed: Aug. 14, 1984

Related U.S. Application Data

[63] Continuation of Ser. No. 384,070, Jun. 1, 1982, abandoned.

[30] Foreign Application Priority Data

Jun. 11, 1981 [JP] Japan ..... 56-88898

[51] Int. Cl.[4] ..... G03G 15/00

[52] U.S. Cl. ..... 355/14 D; 355/14 CH; 355/14 E

[58] Field of Search ..... 355/14 R, 14 D, 14 CH, 355/14 E, 3 DD, 10, 67–71, 35–38, 41–43, 83, 8

[56] References Cited

U.S. PATENT DOCUMENTS 2,956,487 10/1960 Giaimo ..... 355/14 D
4,239,374 12/1980 Tatsumi et al. ..... 355/14 D
4,248,524 2/1981 Takahashi ..... 355/14 CH
4,348,100 9/1982 Snelling ..... 355/14 D

*Primary Examiner*—R. L. Moses

*Attorney, Agent, or Firm*—Fitzpatrick, Cella, Harper & Scinto

[57] ABSTRACT

The invention provides an image formation apparatus having a photosensitive drum, primary and secondary chargers which are controlled by first and second high voltage transformers, respectively, a predischarge charger controlled by a predischarge high voltage transformer, a transfer charger controlled by a transfer high voltage transformer, an exposure lamp controlled by a light control circuit, a developing roller which receives a controlled bias voltage from an AC developing bias circuit, a surface potentiometer, and a microprocessor. In preliminary exposure, an original is exposed to light to form an electrostatic latent image on the photosensitive drum. The potential of this latent image is measured by the surface potentiometer so as to detect the potential of the original. Based on the potential of the original and hence a detected density of an image of the original, image formation conditions such as a development bias voltage, corona charge, and an original exposure voltage are corrected.

22 Claims, 6 Drawing Figures

IMAGE FORMATION APPARATUS INCLUDING MEANS FOR DETECTING AND CONTROLLING IMAGE FORMATION CONDITION

This is a continuation of application Ser. No. 384,070 filed June 1, 1982 now abandoned.

BACKGROUND OF THE INVENTION

1. Field of the Invention

The present invention relates to an image formation apparatus for forming a stable image by the electrostatic recording method wherein recording conditions of an image are controlled in accordance with surface conditions of a recording medium.

2. Description of the Prior Art

In image formation apparatus such as copying machines which record images in accordance with the electrostatic recording method, a potentiometer for measuring a surface potential is generally arranged near a recording medium, for example, near a photosensitive drum. A light color area and a dark color area are formed on the photosensitive drum to control various image formation conditions such as charge, exposure and development conditions in accordance with the measured results of the surface potential of the photosensitive drum whereby an optimum image is formed. However, in the conventional device of this type, potentials at the light color areas and the dark color areas are not measured in accordance with an original image, respectively. Therefore, even if the image formation conditions described above are controlled, the optimum image cannot be recorded, resulting in a low density image or a poor background appearence on the copying medium in accordance with a density difference of the background of various originals.

SUMMARY OF THE INVENTION

The present invention has been made to solve the above problems and has for its object to provide an image formation apparatus which controls image formation conditions in accordance with an original image to reproduce an excellent image.

It is another object of the present invention to provide an image formation apparatus which controls the image formation conditions by utilizing reciprocal movement of a moving means for exposing the original image.

It is still another object of the present invention to provide an image formation apparatus which controls image formation conditions in two different modes.

The above and other objects of the present invention will be apparent from the following description taken in conjunction with the accompanying drawings.

BRIEF DESCRIPTION OF THE DRAWINGS

FIG. 5-1 shows timing charts of signals in accordance with one example of the copy operation of the image formation apparatus of the present invention; and FIG. 5-2 shows timing charts of signals when normal original exposure is performed by reciprocal movement of an optical system or an original table.

DETAILED DESCRIPTION OF THE PREFERRED EMBODIMENTS

An image formation apparatus according to one embodiment of the present invention will be described with reference to the accompanying drawings.

Figure 1:
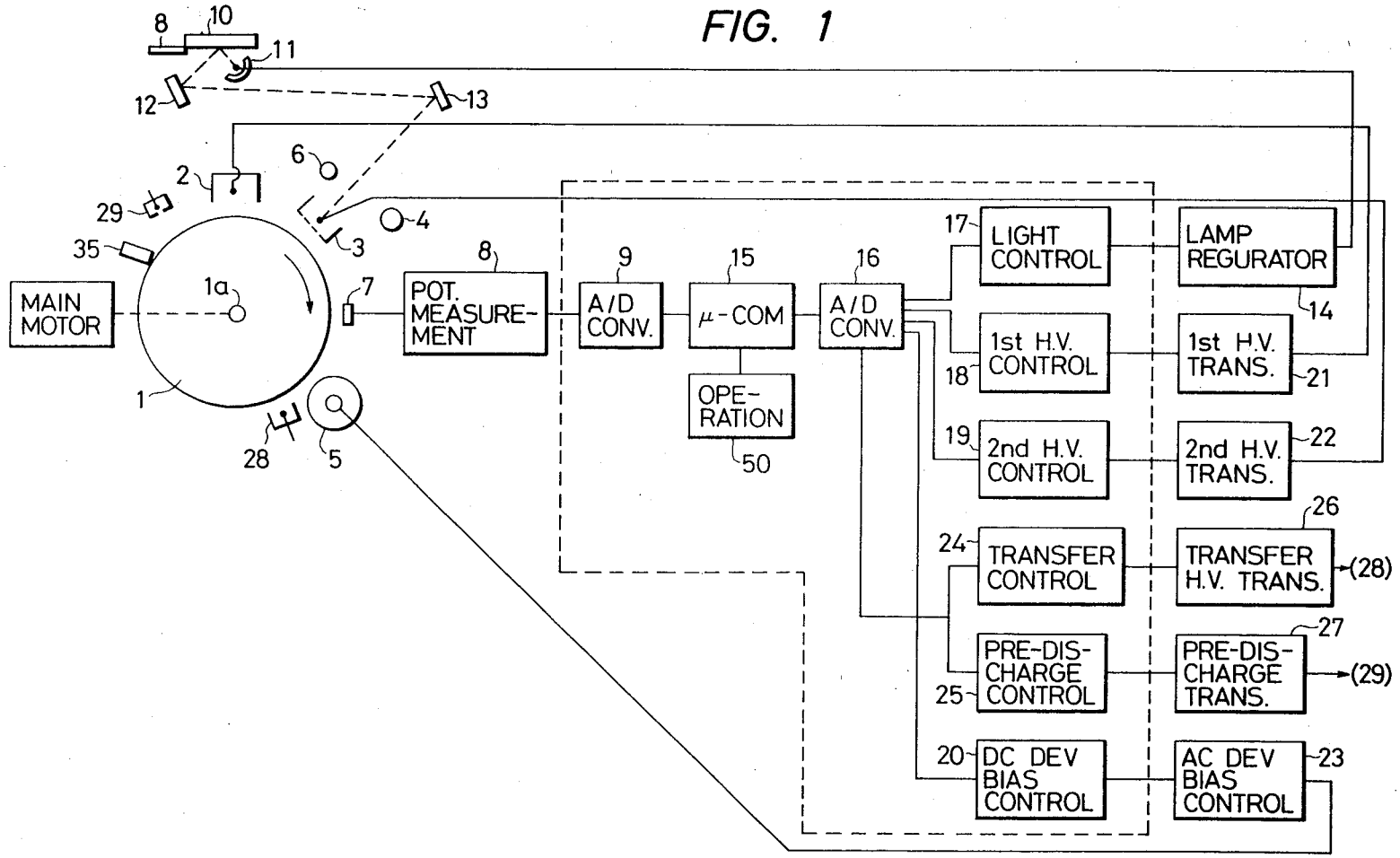
FIG. 1 is a view showing the overall arrangement of an image formation apparatus according to the present invention.

FIG. 1 shows the overall arrangement of the image formation apparatus according to the present invention. A photosensitive body or photosensitive drum 1 comprises three layers at its surface, that is, an insulating layer, a photoconductive layer, and an electrically conductive layer. The photosensitive drum 1 is supported on a main body (not shown) and is free to rotate about an axis 1*a* in the direction shown by an arrow. A primary charger 2, a secondary charger 3, an entire surface exposure lamp 4, a potentiometer 7, a developing roller 5 of a developing unit, a transfer charger 28, a cleaner blade 35 for removing toner from the surface of the photosensitive drum 1, and a predischarge charger 29 are disposed around the photosensitive drum 1 along the direction of rotation thereof in the order named.

When the photosensitive drum 1 is predischarged by the predischarge charger 29 before the subsequent processes, the entire surface of the photosensitive drum 1 is uniformly charged (e.g., positive) by the primary charger 2. A reflected light beam from an original 10 which is illuminated by an original exposure lamp 11 is radiated on the photosensitive drum 1 through mirrors 12 and 13. In this condition, AC corona discharge or corona discharge having an opposite polarity to that of the primary charger 2 is performed by the secondary charger 3 to form an electrostatic latent image in accordance with an original image. The entire surface of the photosensitive drum 1 is then exposed by the entire surface exposure lamp 4, so that an electrostatic latent image having a high contrast is formed. This latent image is then toner developed by the developing roller 5. Since an AC bias voltage is applied to the developing roller 5 as will be described later, an image of excellent gradation is obtained by the jumping phenomenon. The transfer charger 28 is then operated to transfer the image to a recording paper sheet (not shown). A blank exposure lamp 6 for preventing adhesion of excessive toner to the photosensitive drum 1 is disposed above the secondary discharger 3. The blank exposure lamp 6 is also used to form light color areas and dark color areas on the photosensitive drum 1 under control with standard image formation conditions.

The potentiometer 7 for measuring a surface potential of the photosensitive drum 1 is disposed between the entire surface exposure lamp 4 and the developing roller 5. A signal from the potentiometer 7 is supplied to an A/D converter 9 through a potential measurement circuit 18 and is converted to a digital signal. This digital signal is supplied to a microcomputer (to be referred to as an MPC hereinafter). An output from the MPC 15 is supplied to a D/A converter 16. The D/A converter 16 is connected to a light control circuit 17, a first high voltage control circuit 18, a second high voltage control circuit 19, a transfer control circuit 24, a predischarge control circuit 25, and a DC development bias control circuit 20. The light control circuit 17 controls the original exposure lamp 11 through a lamp regulator 14. The first and second high voltage control circuits 18 and 19 are connected to the primary charger 2 and to the secondary charger 3 through the first and second high voltage transformers 21 and 22, respectively, to control the charge of the primary and secondary chargers 2 and 3. The transfer control circuit 24 is connected to the transfer charger 28 through a transfer high voltage transformer 26. The predischarge control circuit 25 is connected to the predischarge charger 29 through the predischarge high voltage transformer 27. An output from the DC development bias control circuit 20 is connected to an AC development bias control circuit 23. An output from the AC development bias control circuit 23 is applied to the developing roller 5. A standard white board 8 is used to control a light amount of the original exposure lamp 11 to be described later. In an operation section 50, various key-in operations and display are performed.

Figure 2:
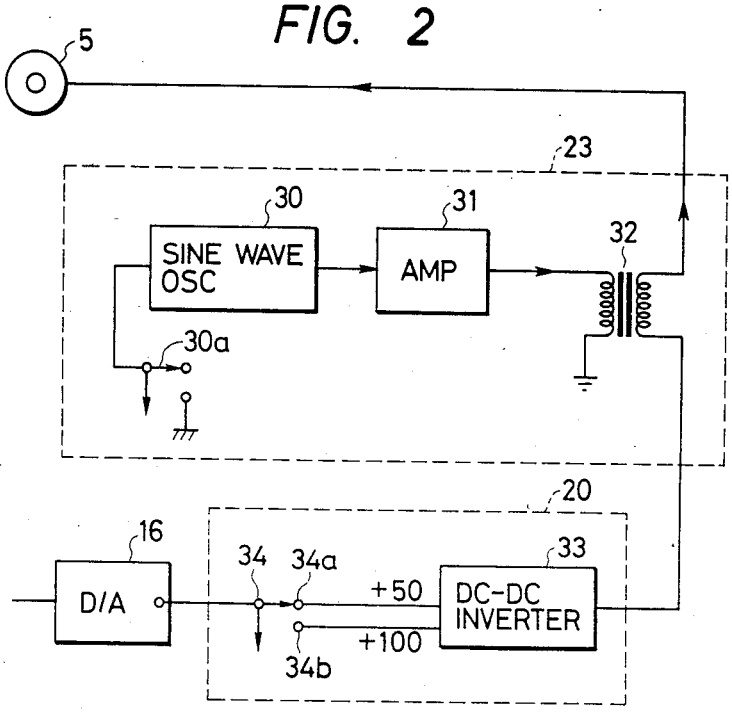
FIG. 2 is a block diagram of a circuit for controlling a development bias voltage.

The DC development bias control circuit 20 and the AC development bias control circuit 23 are arranged as shown in FIG. 2. Referring to FIG. 2, a sinusoidal wave oscillator circuit 30 is connected to an amplifier circuit 31. An AC voltage from the sinusoidal wave oscillator circuit 30 is applied to a primary winding of a booster transformer 32. A voltage induced at one terminal of a secondary winding of the transformer 32 is applied to the developing roller 5. The other terminal of the secondary winding of the transformer 32 is connected to a DC-DC inverter 33 and is connected to the D/A converter 16 through a switch 34. Thus, the DC development bias control circuit in FIG. 1 is constituted. The switch 34 is used to select manual exposure and automatic exposure. In the automatic exposure mode, the switch 34 is switched to a contact 34*a*, while it is switched to a contact 34*b* in the manual exposure mode. Therefore, different DC development bias voltages are generated in these modes, respectively.

Figure 3:
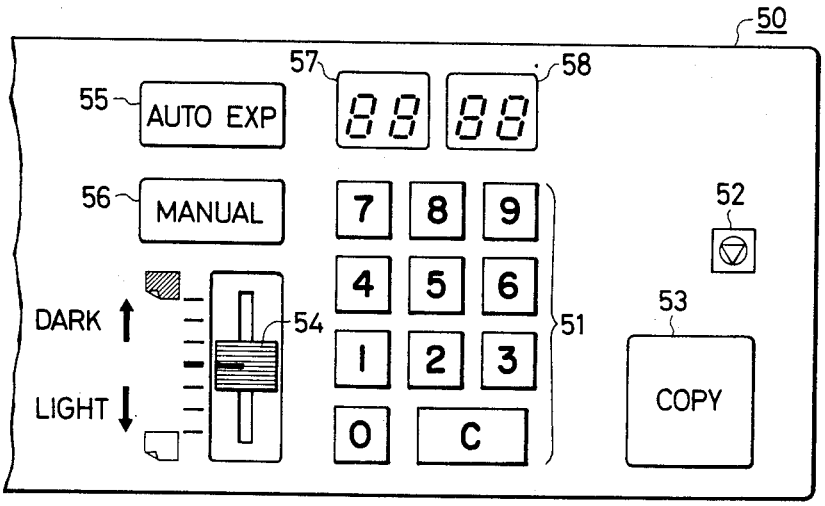
FIG. 3 is a plan view partially showing a control section.

FIG. 3 is a plan view partially showing the operation section 50 of the copying machine shown in FIGS. 1 and 2. Numeric keys 51 having keys 0 to 9 are used to set a desired number of copies. The selected number at a maximum of 99 is displayed at a display 57. A clear key C is used to clear the set number which is displayed at the display 57 to zero.

A stop key 52 is used to interrupt the copy operation before the copy count reaches the set number. When the operator depresses the stop key 52, the current process is performed and then the copy cycle is terminated. A start key 53 is used to initiate the copy operation. The displays 57 and 58 are 7-segment displays which comprise light-emitting diodes or liquid crystal display elements. The display 57 is used to display the set number of copies, while the display 58 is used to display the copy count number. A lever 54 is used to adjust the density of an image, while a key 55 is used to select the automatic exposure mode to be described later, and a key 56 is used to select the manual exposure mode. The operator can manually adjust the lever 54 to obtain a desired density of the image after depressing the key 56. However, if the key 55 is turned on, the switch 34 in FIG. 2 is switched to the contact 34*a* and the key 56 is turned on. Thus, the switch 34 is switched to the contact 34*b*. The development bias voltage can be changed by the lever 54 to determine the density of the image.

The automatic and manual exposure modes will be described. In the automatic exposure mode, the device is standardized by the standard light beam and the original image conditions are detected. Thereafter, image formation conditions such as the development bias voltages are determined in accordance with detected outputs. Prior to the standard original exposure, the original is exposed to form an electrostatic latent image on the photosensitive drum 1. The potential of the electrostatic latent image is measured by the potentiometer 7 to detect the surface potential at the original. The development bias voltage, the corona charge voltage and the original exposure voltage are determined on the basis of the surface potential. Therefore, an input operation with the lever 54 cannot be performed in the automatic exposure mode.

In the manual exposure mode, the standard amount of light is radiated on the photosensitive drum 1 and the potential at the portion of the photosensitive drum 1 on which the light beam is radiated is measured. The development bias voltage and the corona charge voltage are controlled in accordance with the measured potential. Radiation of the standard amount of light beams on the photosensitive drum 1 is performed such that the amount of light beams obtained when the lever 54 is kept at the middle position is first radiated on the standard white board 8 and the reflected light beams are radiated on the photosensitive drum 1. In the manual exposure mode, an input operation with the lever 54 can be performed. Further, a blank light beam can be used as the standard light beam.

Figure 4:
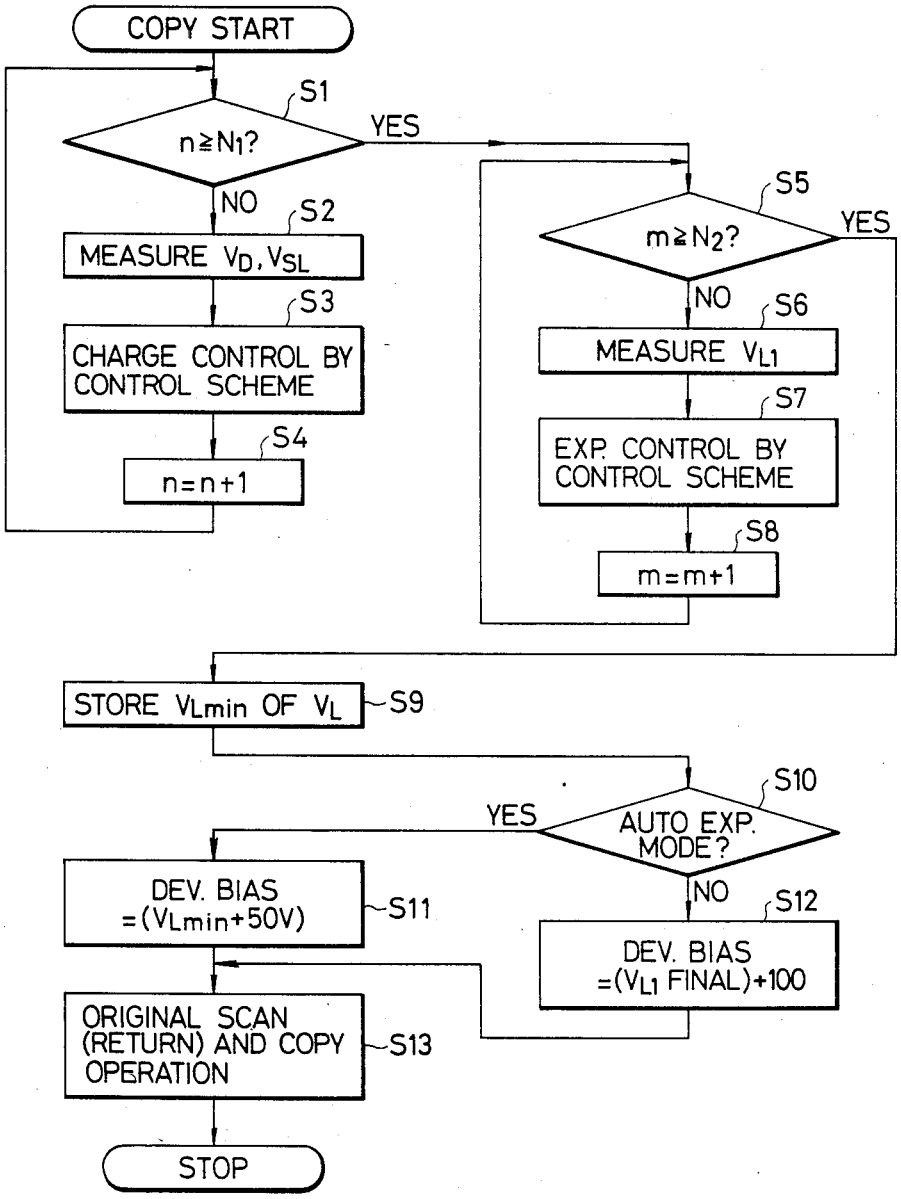
FIG. 4 is a flowchart for explaining the control operation.

FIG. 4 is a flowchart for explaining the mode of control operation of the image formation apparatus according to the present invention. This mode of operation will be described below.

In the arrangement shown in FIGS. 1 and 2, prior to image recording, the original exposure lamp 11 or the blank exposure lamp 6 is flashed to form, on the photosensitive drum 1, a light control area of a potential $V_{SL}$ exposed with strong light beams and a dark color area of a potential $V_D$ exposed with weak light beams. These latent image potentials are detected by the potentiometer 7 (step S2 in FIG. 4) and are converted to predetermined levels by the potential measurement circuit 18. These converted signals are then converted to digital signals in the A/D converter 9. The MPC 15 produces control data so as to allow the digital values representing the surface potentials $V_{SL}$ and $V_D$ to draw near to target values.

In step S3, a primary current $I_1$ and a secondary current $I_2$ flowing through the primary and secondary chargers 2 and 3, respectively, are controlled by the following equations:

$$\Delta I_1 = \alpha_1 \Delta V_D + \alpha_2 \Delta V_{SL}$$

$$\Delta I_2 = \beta_1 \Delta V_D + \beta_2 \Delta V_{SL}$$

where $\Delta I_1$ and $\Delta I_2$ are changes, $\Delta V_D$ and $\Delta V_{SL}$ are deviations of the surface potentials $V_{SL}$ and $V_D$ from the target values, and $\alpha_1$, $\alpha_2$, $\beta_1$ and $\beta_2$ are control coefficients.

The control data is converted to analog values in the D/A converter 16 and the analog values are supplied to the first and second light voltage control circuits 18 and 19. The first high voltage transformer 21 is controlled by the first high voltage control circuit 19, which also controls the charge of the primary charger 2. Similarly, the second high voltage transformer 22 is controlled by the second high voltage control circuit 19, which also controls the charge of the secondary charger 3. Thus, the potentials $V_{SL}$ and $V_D$ reach near the target values.

The charge control is performed only the number of times $N_1$ which varies depending on the non-operation time interval after the previous copy operation, as shown in step S1. If a count is below the predetermined number of times, the count is increased in unitary increments in step S4 so that the predetermined number of times of charge operations are performed to control the charge operation. If the potentials $V_{SL}$ and $V_D$ reach the target values, the charging operation may be interrupted before the count reaches the predetermined number of times $N_1$.

After the charge control is completed, the blank exposure lamp 6 is turned off. The standard white board 8 is then illuminated by the amount of light beams from the original exposure lamp 11 to control the amount of light beams from the original exposure lamp 11 in steps S5 to S8. Predetermined data produced by the MPC 15 is converted to an analog value in the D/A converter 16 and an ON voltage controlled by the lamp regulator 14 through the light control circuit 17 is given to the original exposure lamp 11 to perform initial illumination. The reflected light beams by the standard white board 8 are guided on the photosensitive drum 1 through the mirrors 12 and 13. A potential $V_{L1}$ at the light color area formed on the photosensitive drum 1 is measured by the potentiometer 7 and the potential measurement circuit 18 (step S6). The measured potential is converted to digital data by the A/D converter 9 and is guided to the MPC 15. Then, calculation is performed in accordance with equation $\Delta V_{HL}=r_1\Delta V_L$ (where $\Delta V_L$ is the deviation of the surface potential from the target value and $r_1$ is the constant) in step S7. The calculated result is converted to an analog value in the D/A converter 16 and is used to control the amount of light which is radiated from the original exposure lamp 11 on the light color area so that the potential $V_{L1}$ reaches the target value. In step S8, the exposure control operation of this type is repeated a predetermined number of times $N_2$ which is determined depending on the same time interval as in charge control. It is determined in step S5 whether or not exposure control is performed the predetermined number of times $N_2$.

As described above, when the predetermined number of times of the exposure control operations is completed, the optical system including the lamp 11, the mirror 12, or an original table (not shown) on which the original 10 is placed is reciprocally moved to scan the original with light beams. Thus, an electrostatic latent image corresponding to the image on the original 10 is formed on the photosensitive drum 1 and the potential of the latent image is measured by the potentiometer 7. A minimum potential $V_{Lmin}$ measured at the electrostatic latent image formed by the light beams reflected by the background of the original is measured and stored (step S9). Thereafter, in step S10, it is determined whether the automatic exposure mode or the manual exposure mode is initiated. If it is determined that the automatic exposure mode is initiated, the switch 34 is switched to the contact 34*a*. In step S11, the development bias voltage through the DC-DC inverter 33 is set to ($V_{Lmin}$+50 V). However, if it is discriminated that the manual exposure mode is initiated, the switch 34 is switched to the contact 34*b*. A voltage ($V_{L1}$+100 V) is applied as the development bias voltage (step S12). Thereafter, the optical system or the original table reaches an inverting position and returns to the initial position. Thus, the optical system or the original table is moved reciprocally. With reciprocal movement, the copy sequence is performed. The electrostatic latent image is formed in accordance with the original 10 and the latent image is developed in accordance with the development bias voltage. Further, the developed image is transferred to a recording paper sheet by the transfer charger 28. The transferred image is then fixed by a fixer (not shown) and the recording paper sheet on which the image is recorded is exhausted outside the copying machine.

Power from the main motor is transmitted to a forward or reverse clutch (not shown), so that the lamp or the original table is reciprocally moved.

Figures 1, 5:
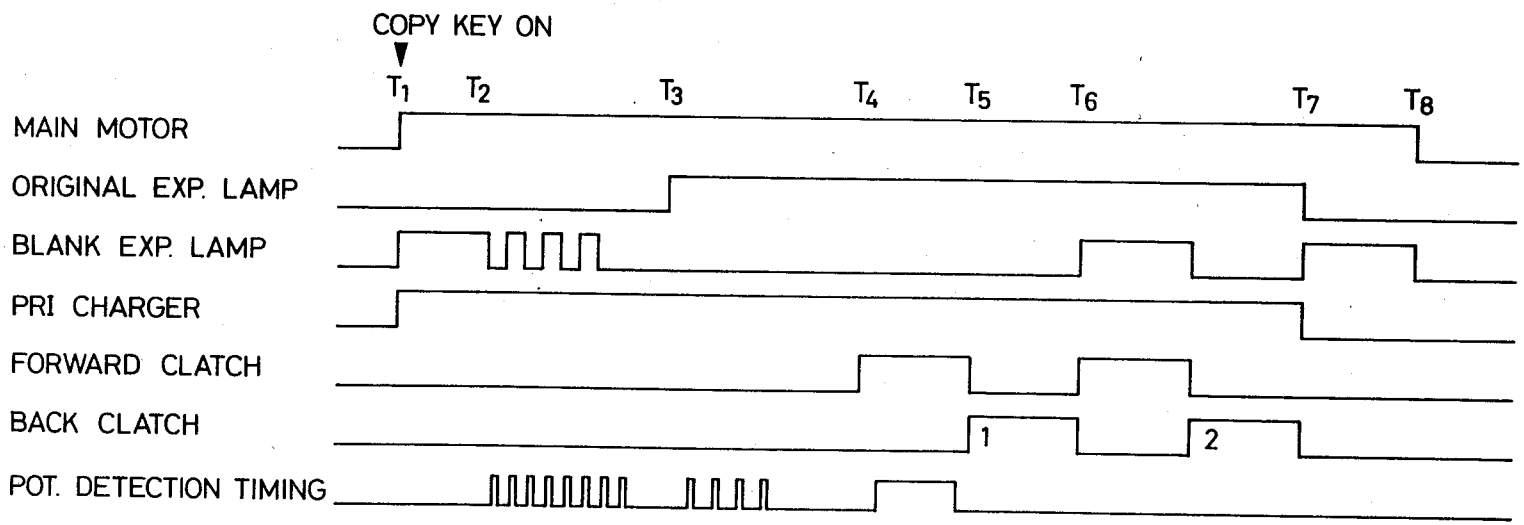
Figures 2, 5:
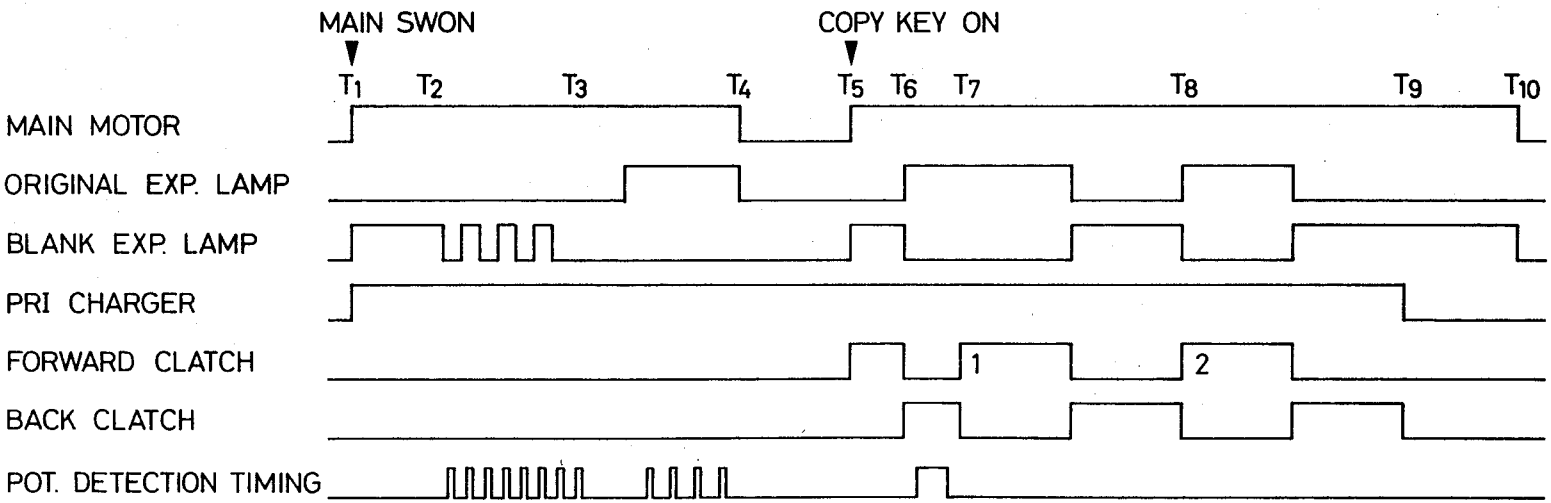

FIG. 5-1 shows timing charts of signals for explaining one example of the copy mode of operation according to the present invention. A case is described in which the automatic exposure mode is initiated and two copies are to be made. When the operator depresses the copy key 53 at time $T_1$, the blank exposure lamp 6, the entire surface exposure lamp 4, the predischarge charger 29, the primary and secondary chargers 2 and 3, and the like are turned on so as to rotate the photoelectric drum 1 and to electrostatically clean the surface thereof before the copy operation. At time $T_2$, the first control rotation is performed and the blank exposure lamp 6 is flashed at a predetermined time interval and the surface potentials $V_{SL}$ and $V_D$ at the light and dark color areas, respectively formed on the photosensitive drum 1 are measured by the potentiometer 7. Thus, the corona currents of the primary and secondary chargers 2 and 3 are controlled. The frequency of measurement of the surface potentials to control the chargers depends upon the non-operation time after the previous copy operation. In this case, the surface potentials are measured and corrected four times.

At time $T_3$, the second control rotation is initiated. The original exposure lamp 11 is turned on and light beams therefrom are radiated on the standard white board 8, while the corona currents still flow. The reflected light beams are then radiated on the photosensitive drum 1. The surface potential $V_L$ is thus measured to control the amount of light radiated from the original exposure lamp 11. In this case, the amount of light is measured three times which is determined according to the non-operation time interval. Finally, the controlled light beams from the original exposure lamp 11 are radiated on the standard white board 8 again. The reflected light beams are then radiated on the photosensitive drum 1. The potential at the radiated area is then measured. In the automatic exposure mode, the development bias voltage is determined depending upon this surface potential.

At time $T_4$, the forward clutch is turned on and the optical system is moved in the forward direction. Thus, exposure (preliminary exposure) of the original is performed. The electrostatic latent image in accordance with the original is formed on the photosensitive drum 1. The potential of the electrostatic latent image is measured by the potentiometer 7 and the minimum potential $V_{Lmin}$ is determined and stored. Thus, as described above, the development bias voltage is determined. At time $T_5$, the reverse clutch is turned on and the optical system is moved in the reverse direction. The standard original exposure is performed and the electrostatic latent image is formed on the photosensitive drum 1 in accordance with the image on the original. This latent image is then developed in accordance with the development bias voltage. Further, the developed image is then transferred onto a first recording paper sheet.

At time $T_6$, the second scanning operation of the optical system is initiated. As described above, the normal original exposure is performed when the optical system returns to the initial position to form an image. From time $T_7$, the photosensitive drum 1 starts rotation. The primary charger 2, the transfer charger 28 and the predischarge charger 29 are turned off. The photosensitive drum 1 is then discharged by the blank exposure lamp 6 and the secondary charger 3.

In the above embodiment, the surface potentials $V_{SL}$ and $V_D$ are measured four times and the corona currents are corrected four times. Further, the surface potential $V_L$ is measured four times and the amount of light radiated from the original exposure lamp is corrected three times. The number of times of measurement of the surface potentials and the number of control operations of the image formation conditions may be determined in accordance with the non-operation time interval, as shown in Table 1.

TABLE 1

| | Operation | Number of Corona Current Corrections | Number of Exposure Corrections |
|---|---|---|---|
| Status 1 | Copy start key is depressed within 30 seconds after the preceding copy operation is completed | Once | None |
| Status 2 | Copy start key is depressed within 30 minutes after the preceding copy operation is completed | Twice | Once |
| Status 3 | Copy start key is depressed within 30 minutes to 5 hours after the preceding copy operation | Three Times | Twice |
| Status 4 | Copy start key is depressed after 5 hours after the preceding copy operation is completed or after the main switch is depressed | Four Times | Three Times |

FIG. 5-2 shows timing charts of signals for explaining the standard original exposure when the optical system or the document table is moved forward. Preliminary exposure is performed to detect the density of the background of the original before the standard original exposure is performed. Preliminary exposure need not be performed to cover the entire surface of the original. For example, the original may be scanned for length half the normal scanning length. Alternatively, half the length of the minimum copying paper sheet may be scanned. The mode of operation will be described with reference to timing charts.

When the operator depresses the main switch, at time $T_1$ to $T_4$, the same control operations as in $T_1$ to $T_4$ in FIG. 5-1 are performed. When the operator then depresses the copy key 53 at time $T_5$, preliminary exposure is initiated. The forward clutch is turned on and the optical system is moved in the forward direction. Thus, the photosensitive drum 1 is standardized. If half of the original is scanned, the original exposure lamp 11 is turned on at time $T_6$. The reverse clutch is then turned on and the optical system is moved in the reverse direction. The electrostatic image according to the image on the original is formed on the standardized area of the photosensitive drum 1. The potential at the electrostatic latent image is measured by the potentiometer 7 so as to store the minimum potential $V_{Lmin}$. In the automatic exposure mode, the development bias voltage is determined as described above.

At times $T_7$ to $T_9$, the second original exposure operation is performed when the optical system is moved in the forward direction. Thus, the second copy is obtained. In the same manner as in FIG. 5-1, the photosensitive drum 1 is then rotated. In FIGS. 5-1 and 5-2, the minimum potential at the electrostatic latent image is measured. However, an average potential may be calculated to control the image formation conditions such as the development bias voltage and the like.

In the above embodiment, the potential at the background of the original is measured to obtain the development bias voltage. However, an image signal of the original may be detected as a potential at the latent image. Further, a ratio of the spatial frequency components may be calculated and converted to a frequency of the AC component of the developing bias voltage so as to control the developing gradation. The changeover of the AC components may be performed by arranging the switch 30*a* to changeover the oscillator frequency.

Further, in the above embodiment, only the potential of the portion of the background of the original which opposes the potentiometer of the photosensitive drum 1 is measured. Therefore, a plurality of potentiometers may be arranged perpendicularly to the rotational direction of the photosensitive drum 1. Alternatively, a scanning optical system may be disposed in the transverse direction of part of the optical path to detect the density of the original. In this case, the potentiometers may be swung in the transverse direction to increase the detection area, resulting in an increase in the detection precision.

The density of the original measured as described above may be performed in preliminary scanning prior to the exposure scanning in which the optical system or the original table is moved reciprocally. Such a measurement must be performed prior to exposure for forming the image.

Further, in the above embodiment, if the scanning speed of the original during image formation differs from that during density measurement, the peak value of the potential at the light color area which is obtained during density detection may be temporarily stored. After the scanning speed adjustment is performed, the development bias voltage is controlled.

In the above embodiment, a case has been described in which the development bias voltage is controlled as one of the image formation conditions. However, the present invention is not limited to this control. A charge current may be controlled. Alternatively, the amount of light may be controlled by controlling the ON voltage of the lamp.

Further, in the above embodiment, a potential is detected. However, the present invention is not limited to this kind of detection. For example, the density of the image on the photosensitive body may be detected.

In summary, the surface conditions of the photosensitive body are measured to determine the density of the original image. Based on the measured results, the image formation conditions are corrected. Therefore, any original may be used to obtain optimum results. Further, after the image formation conditions are standardized, the density of the original image is detected, and the image formation conditions are corrected, so that optimum image recording is performed.

What we claim is:

1. An image formation apparatus comprising:

image forming means for forming an image of an original on a recording medium;

standardizing means for standardizing image formation conditions of said image forming means prior to the operation of said image forming means to form an original image on the recording medium and without regard to conditions of the original;

detecting means for detecting conditions of the image of the original after completion of standardization of said image formation conditions by said standardizing means; and controlling means coupled to an output of said detecting means for controlling the image formation conditions in response to said detection by said detecting means so as to form an image in accordance with the image of the original.

2. An apparatus according to claim 1, wherein said standardizing means standardizes the image formation conditions in cooperation with said detecting means.

3. An apparatus according to claim 2, wherein said detecting means detects conditions of the original by detecting an image on a photosensitive body.

4. An apparatus according to claim 3, wherein the image on said photosensitive body is an electrostatic latent image.

5. An apparatus according to claim 4, wherein the electrostatic latent image is an image corresponding to the original at a time of prescanning of said original.

6. An apparatus according to claim 1, wherein standardization control of the image formation conditions by said standardizing means varies depending on a status of said apparatus.

7. An image formation apparatus comprising:

a photosensitive body;

image forming means for forming an electrostatic latent image corresponding to an image of an original on said photosentive body, said image forming means including charging means for uniformly charging a recording medium, exposing means for exposing said recording medium to light, and developing means for developing an electrostatic latent image formed on said photosensitive body;

means for standardizing image forming conditions of said image forming means prior to the operation of said charging means to form an original image;

detecting means for detecting surface conditions of said photosensitive body; and control means coupled to an output of said detecting means for controlling said image forming means to form the electrostatic latent image in accordance with said detecting means output, wherein said detecting means detects the surface conditions of said photosensitive body in accordance with the image of the original formed in a preliminary exposure mode after completion of standardization of said image formation conditions of said image forming means in a test mode.

8. An apparatus according to claim 7, wherein said controlling means controls developing conditions of said developing means.

9. An apparatus according to claim 8, wherein the developing conditions comprise a development bias voltage.

10. An apparatus according to claim 7, wherein said controlling means establishes a different control mode for the standardization in accordance with the status of said apparatus in the test mode.

11. An apparatus according to claim 7 or 10, wherein said controlling means standardizes the image formation conditions by controlling said charging means in the test mode.

12. An apparatus according to claim 10, wherein the status of said device comprises a non-operating time interval of said apparatus.

13. An apparatus according to claim 7, wherein said detecting means detects a surface potential of said photosensitive body.

14. An image formation apparatus comprising:

an image forming means for forming an image of the original on a recording medium;

detecting means for detecting conditions of an original image formed on an intermediate medium, wherein a signal at an output of said detecting means relates to conditions of the original image;

control means coupled to the output of said detecting means for controlling image formation conditions of said image forming means, said controlling means being operative in a first mode in which the image formation conditions are controlled in accordance with the conditions of the original image in response to said detection by said detecting means, and being operative in a second mode in which the image formation conditions are controlled in a predetermined condition independently of the conditions of the original; and selecting means for selecting one of the first and second modes.

15. An apparatus according to claim 14, wherein said detecting means detects the conditions of the original by detecting an image formed on a photosensitive body.

16. An apparatus according to claim 15, wherein the image on the photosensitive body is an electrostatic latent image.

17. An apparatus according to claim 14, wherein said controlling means controls the image formation conditions in cooperation with said detecting means in the second mode to standardize the image formation conditions.

18. An apparatus according to claim 14 or 7, wherein said image forming means has exposing means for exposing said recording medium, and wherein said predetermined condition is a condition in which a standard amount of light is radiated on said recording medium by said exposing means.

19. An apparatus according to claim 18, wherein light from said exposing means is radiated on a standard white board, and the standard amount of light is radiated on said recording medium in accordance with light reflected by said standard white board.

20. An apparatus according to claim 14, wherein said image formation means has developing means for developing an electrostatic latent image on said photosensitive body, and said controlling means controls developing conditions of said developing means.

21. An apparatus according to claim 20, wherein the developing conditions comprises a development bias voltage.

22. An image formation apparatus comprising:

a photosensitive body;

image forming means for forming an electrostatic latent image corresponding to an image of an original on said photosensitive body, said image forming means including charging means for uniformly charging a recording medium, exposing means having reciprocating means for scanning the original for exposing said recording medium to image light, and developing means for developing an electrostatic latent image formed on said photosensitive body;

detecting means for detecting surface conditions of said photosensitive body; and control means coupled to an output of said detecting means for controlling said image forming means in response to said detection by said detecting means, wherein said detecting means detects the surface conditions corresponding to the original image formed on said photosensitive body by means a forward movement of said reciprocating means in a preliminary exposure mode after image formation conditions of said image forming means are standardized in a test mode, and wherein said control means controls the image formation conditions based on controlled image formation conditions at the time of a backward movement of said reciprocating means.

* * * * *

UNITED STATES PATENT AND TRADEMARK OFFICE

CERTIFICATE OF CORRECTION

PATENT NO. : 4,564,287

DATED : January 14, 1986

INVENTOR(S) : KOJI SUZUKI, ET AL.

It is certified that error appears in the above-identified patent and that said Letters Patent is hereby corrected as shown below:

FIG. 5-1

Sheet 4 of 5, "FORWARD CLATCH" should read --FORWARD CLUTCH--.
"BACK CLATCH" should read --BACK CLUTCH--.

FIG. 5-2

Sheet 5 of 5, "MAIN SWON" should read --MAIN SW ON--.
"FORWARD CLATCH" should read --FORWARD CLUTCH--.
"BACK CLATCH" should read --BACK CLUTCH--.

COLUMN 1

Line 34, "appearence" should read --appearance--.

COLUMN 9

Line 39, "photosentive" should read --photosensitive--.

COLUMN 10

Line 44, "14 or 7" should read --14 or 17--
Line 61, "comprises" should read --comprise--.

UNITED STATES PATENT AND TRADEMARK OFFICE

CERTIFICATE OF CORRECTION

PATENT NO. : 4,564,287

DATED : January 14, 1986

INVENTOR(S) : KOJI SUZUKI, ET AL.

It is certified that error appears in the above-identified patent and that said Letters Patent is hereby corrected as shown below:

COLUMN 12

Line 2, "by means a" should read --by means of a--.

Signed and Sealed this

Fifteenth Day of September, 1987

*Attest:*

DONALD J. QUIGG

*Attesting Officer*

*Commissioner of Patents and Trademarks*